US011844451B2

(12) United States Patent
Pearce et al.

(10) Patent No.: US 11,844,451 B2
(45) Date of Patent: Dec. 19, 2023

(54) PILLOW INCLUDING GELATINOUS ELASTOMER CUSHION HAVING DEFORMABLE WALL MEMBERS AND RELATED METHODS

(71) Applicant: Purple Innovation, LLC, Lehi, UT (US)

(72) Inventors: Tony M. Pearce, Alpine, UT (US); Shawn D. Moon, Cedar Hills, UT (US)

(73) Assignee: Purple Innovation, LLC, Lehi, UT (US)

( * ) Notice: Subject to any disclaimer, the term of this patent is extended or adjusted under 35 U.S.C. 154(b) by 577 days.

(21) Appl. No.: 17/021,962

(22) Filed: Sep. 15, 2020

(65) Prior Publication Data

US 2020/0405082 A1 Dec. 31, 2020

Related U.S. Application Data

(63) Continuation of application No. 15/333,486, filed on Oct. 25, 2016, now Pat. No. 10,772,445.
(Continued)

(51) Int. Cl.
*A47G 9/10* (2006.01)
*A47G 9/02* (2006.01)
*A47G 9/00* (2006.01)

(52) U.S. Cl.
CPC ..... *A47G 9/1027* (2013.01); *A47G 9/0253* (2013.01); *A47G 9/10* (2013.01);
(Continued)

(58) Field of Classification Search
CPC ..... A47G 9/1027; A47G 9/0253; A47G 9/10; A47G 2009/003; A47G 2009/008;
(Continued)

(56) References Cited

U.S. PATENT DOCUMENTS 2,958,885 A 11/1960 Donney
4,369,284 A 1/1983 Chen
(Continued)

FOREIGN PATENT DOCUMENTS

CN 1615771 A 1/2008
CN 201097890 Y 8/2008
(Continued)

OTHER PUBLICATIONS

Korean Intellectual Property Office, "Notice of Final Rejection," Korean Application No. 10-2019-7009876, dated Nov. 11, 2021.
(Continued)

*Primary Examiner* — Eric J Kurilla
(74) *Attorney, Agent, or Firm* — DENTONS Durham Jones Pinegar

(57) ABSTRACT

A pillow includes a pillow cushion consisting essentially of a gelatinous elastomer that is sized and configured to support a head and neck of a person using the pillow cushion. The pillow cushion has a first major surface, a second major surface, and deformable wall members extending between the first major surface and the second major surface. The deformable wall members are located and configured to define voids therebetween such that the deformable wall members may be displaced into adjacent voids upon deformation of the deformable wall members. The deformable wall members are configured to buckle when a pressure applied to a cushioning surface of the pillow cushion, in a direction perpendicular to the first major surface, exceeds a threshold pressure level. A pillow cover covers the pillow cushion. A method of fabricating a pillow includes enclosing such a cushion in a pillow cover.

21 Claims, 6 Drawing Sheets

Related U.S. Application Data

(60) Provisional application No. 62/397,818, filed on Sep. 21, 2016.

(52) U.S. Cl.
CPC .. *A47G 2009/003* (2013.01); *A47G 2009/008* (2013.01); *A47G 2009/1018* (2013.01)

(58) Field of Classification Search
CPC ..... A47G 2009/1018; A61G 5/1043; A61G 5/1045; A61G 5/1084
See application file for complete search history.

(56) References Cited

U.S. PATENT DOCUMENTS

| | | | | |
|---|---|---|---|---|
| 4,603,445 | A | 8/1986 | Spann | |
| D308,453 | S | 6/1990 | Elrod | |
| D322,533 | S | 12/1991 | Hudson | |
| 5,134,735 | A | 8/1992 | Rose | |
| 5,243,722 | A * | 9/1993 | Gusakov | A61G 5/1043 297/DIG. 3 |
| D352,858 | S | 11/1994 | Farley | |
| D355,322 | S | 2/1995 | Ackley et al. | |
| D372,158 | S | 7/1996 | Bonaddio et al. | |
| D375,863 | S | 11/1996 | Bigolin | |
| 5,661,556 | A | 8/1997 | Schiff et al. | |
| 5,749,111 | A * | 5/1998 | Pearce | B29C 48/11 428/137 |
| D395,780 | S | 7/1998 | Denny et al. | |
| D414,976 | S | 10/1999 | Su et al. | |
| 5,992,106 | A | 11/1999 | Carling et al. | |
| 5,994,450 | A | 11/1999 | Pearce | |
| 6,026,527 | A | 2/2000 | Pearce | |
| 6,108,835 | A | 8/2000 | Hwang | |
| D453,880 | S | 2/2002 | Cheynet | |
| 6,413,458 | B1 | 7/2002 | Pearce | |
| 6,498,198 | B2 | 12/2002 | Pearce | |
| 6,551,053 | B1 | 4/2003 | Schuetz | |
| D517,848 | S | 3/2006 | Contreras | |
| 7,060,213 | B2 | 6/2006 | Pearce | |
| D527,564 | S | 9/2006 | Contreras | |
| 7,964,664 | B2 | 6/2011 | Pearce | |
| 8,424,137 | B1 | 4/2013 | Pearce et al. | |
| D692,674 | S | 11/2013 | Clerici et al. | |
| 8,784,982 | B2 | 7/2014 | Pearce et al. | |
| D710,116 | S | 8/2014 | Blackford | |
| 8,793,821 | B2 | 8/2014 | Fowkes et al. | |
| 8,919,750 | B2 | 12/2014 | Pearce et al. | |
| 8,932,692 | B2 | 1/2015 | Pearce | |
| 9,038,221 | B2 | 5/2015 | Fraser | |
| D731,820 | S | 6/2015 | Lechantre et al. | |
| 9,051,169 | B2 | 6/2015 | Pearce et al. | |
| 9,265,354 | B2 | 2/2016 | Mason | |
| D758,101 | S | 6/2016 | Mason | |
| D758,102 | S | 6/2016 | Mason | |
| D760,502 | S | 7/2016 | Oh et al. | |
| D775,864 | S | 1/2017 | Bertocello et al. | |
| D790,254 | S | 6/2017 | Brown | |
| D792,127 | S | 7/2017 | Roberts et al. | |
| 9,737,152 | B2 | 8/2017 | Mason | |
| D799,858 | S | 10/2017 | Pearce et al. | |
| D804,856 | S | 12/2017 | Desodt et al. | |
| D804,859 | S | 12/2017 | Desodt et al. | |
| 9,907,343 | B2 | 3/2018 | Lacey et al. | |
| D840,724 | S | 2/2019 | Dowd | |
| 10,206,512 | B2 | 2/2019 | Kim et al. | |
| D845,677 | S | 4/2019 | Desodt et al. | |
| D846,310 | S | 4/2019 | Klobuchar | |
| D864,613 | S | 10/2019 | Pearce et al. | |
| 10,772,445 | B2 | 9/2020 | Pearce et al. | |
| 10,863,837 | B2 | 12/2020 | Pearce et al. | |
| D909,092 | S | 2/2021 | Pearce et al. | |
| 2001/0042271 | A1 | 11/2001 | Pearce | |
| 2002/0078507 | A1 | 6/2002 | Pearce | |
| 2002/0189016 | A1 * | 12/2002 | Habboub | B60N 2/707 5/654 |
| 2004/0187210 | A1 * | 9/2004 | Hickman | A47G 9/0253 5/482 |
| 2005/0017396 | A1 | 1/2005 | Pearce et al. | |
| 2005/0060806 | A1 | 3/2005 | Wilkinson | |
| 2005/0172410 | A1 * | 8/2005 | Huang | A47G 9/0246 5/636 |
| 2007/0061978 | A1 | 3/2007 | Losio | |
| 2008/0244832 | A1 | 10/2008 | Kuo | |
| 2008/0271250 | A1 | 11/2008 | Poppe | |
| 2010/0227091 | A1 * | 9/2010 | Pearce | B32B 3/08 428/36.1 |
| 2012/0017374 | A1 | 1/2012 | Hunter et al. | |
| 2012/0131752 | A1 | 5/2012 | Mason | |
| 2012/0276339 | A1 | 11/2012 | Pearce et al. | |
| 2013/0043628 | A1 * | 2/2013 | Pearce | A47C 7/02 267/153 |
| 2013/0139321 | A1 | 6/2013 | McCausland et al. | |
| 2013/0167302 | A1 | 7/2013 | Pearce | |
| 2014/0259426 | A1 | 9/2014 | Pearce | |
| 2015/0000042 | A1 | 1/2015 | Randall | |
| 2016/0157629 | A1 | 6/2016 | Poppe | |
| 2016/0166092 | A1 | 6/2016 | Alletto | |
| 2017/0020312 | A1 * | 1/2017 | Davis | A47G 9/10 |
| 2017/0128307 | A1 | 5/2017 | Kim | |
| 2017/0254379 | A1 | 9/2017 | Whatcott | |
| 2018/0078062 | A1 | 3/2018 | Pearce et al. | |
| 2018/0140116 | A1 | 5/2018 | Werner | |

FOREIGN PATENT DOCUMENTS

| | | | |
|---|---|---|---|
| CN | 201384307 | Y | 1/2010 |
| CN | 201782434 | U | 4/2011 |
| CN | 301837053 | S | 4/2011 |
| CN | 202820602 | U | 3/2013 |
| CN | 104433501 | A | 3/2015 |
| EP | 2649909 | A1 | 10/2013 |
| JP | 2001104129 | | 4/2001 |
| JP | 2001514912 | A | 9/2001 |
| JP | 2002360402 | A | 12/2002 |
| JP | 2003061802 | A | 3/2003 |
| JP | 2005-152480 | A | 6/2005 |
| JP | 2005143552 | A | 6/2005 |
| JP | 3140168 | U | 3/2008 |
| JP | 5766373 | B1 | 8/2015 |
| JP | 2015139509 | A | 8/2015 |
| JP | 2014533550 | A | 12/2019 |
| KR | 200315096 | Y1 | 6/2003 |
| KR | 10-0671937 | B1 | 1/2007 |
| KR | 20-0468668 | Y1 | 12/2012 |
| KR | 20150009457 | A | 1/2015 |
| KR | 101553373 | B1 | 9/2015 |
| KR | 20160036199 | A | 4/2016 |
| KR | 10-2079421 | B1 | 4/2020 |
| TW | M470585 | U | 1/2014 |
| TW | M498549 | U | 4/2015 |
| WO | 2016088977 | A1 | 6/2016 |
| WO | 2016111434 | A1 | 7/2016 |

OTHER PUBLICATIONS

United States International Trade Commission, "Respondents' Joint Disclosure of Initial Invalidity Contentions," Investigation No. 337-TA-1328, Dec. 2, 2022.

Korean Intellectual Property Office, "Notice of Preliminary Rejection," Korean Application No. 10-2022-7036758, dated Nov. 28, 2022.

Japan Patent Office, "Notice of Allowance," Japanese Application No. 2019-167768, dated Jan. 4, 2023.

Korean Intellectual Property Office, "Notice of Preliminary Rejection," Korean Application No. 10-2022-7036762, dated Nov. 28, 2022.

Chinese National Intellectual Property Administration, "Office Action," Chinese Application No. 201780005390.3, dated Sep. 23, 2021.

Japan Patent Office, "Office Action," Japanese Application No. 2019-167768, dated Jul. 6, 2021.

(56) References Cited

OTHER PUBLICATIONS

Chinese National Intellectual Property Administration, "Fourth Office Action," Chinese Application No. 201780005390.3, dated Jun. 1, 2021.
Korean Intellectual Property Office, "Notice of Preliminary Rejection," Korean Application No. 10-2019-7009876, dated May 15, 2021.
Korean Intellectual Property Office, "Notice of Final Rejection," Korean Application No. 10-2019-7009876, dated Feb. 9, 2022.
European Patent Office, "Extended European Search Report," European application No. 17853779.1, dated Apr. 22, 2022.
Japan Patent Office, "Reasons for Rejection", Japanese Application No. 2019-514114, dated Jul. 30, 2019.
USPTO as International Searching Authority, "International Search Report and Written Opinion," International Application No. PCT/US2017/052421, dated Jan. 18, 2018.
Taiwan Intellectual Property Office, "Office Action and Search Report", Taiwan Application No. 106132218, dated May 7, 2018.
Chinese National Intellectual Property Administration, "First Office Action", Chinese Application No. 201780005390.3, dated Sep. 29, 2019.
European Patent Office, "Extended European Search Report," European Application No. 17853779.1, dated Apr. 28, 2020.
Canadian Intellectual Property Office, "Examiner's Report," Canadian Application No. 3037403, dated Apr. 29, 2020.
Chinese National Intellectual Property Administration, "Second Office Action," Chinese Application No. 201780005390.3, dated Jun. 1, 2020.
Chinese National Intellectual Property Administration, "Third Office Action," Chinese Application No. 201780005390.3, dated Jan. 6, 2021.
Korean Intellectual Property Office, "Notice of Final Rejection," Korean Application No. 10-2019-7009876, dated Jun. 23, 2022.
Japan Patent Office, "Final Office Action," Japanese Application No. 2019-167768, dated Apr. 28, 2022.

* cited by examiner

PILLOW INCLUDING GELATINOUS ELASTOMER CUSHION HAVING DEFORMABLE WALL MEMBERS AND RELATED METHODS

CROSS-REFERENCE TO RELATED APPLICATIONS

This application is a continuation of U.S. patent application Ser. No. 15/333,486 filed on Oct. 25, 2016 and titled PILLOW INCLUDING GELATINOUS ELASTOMER CUSHION HAVING DEFORMABLE WALL MEMBERS AND RELATED METHODS ("the '486 application"), now U.S. Pat. No. 10,772,445, issued Sep. 15, 2020, in which a claim for priority to the Sep. 21, 2016 filing date of U.S. Provisional Patent Application No. 62/397,818 ("the '818 Provisional Application") was made pursuant to 35 U.S.C. § 119(e). The entire disclosures of the '486 Application and the '818 Provisional Application are hereby incorporated herein.

TECHNICAL FIELD

Embodiments of the disclosure relate generally to pillows, and to methods of making pillows. More particularly, embodiments of the present disclosure relate to pillows that include a gelatinous elastomer cushion having deformable wall members, and to methods of making and using such pillows.

BACKGROUND

Pillows are used to support the head and neck while sleeping or lying down. Pillows typically consist of a fabric envelope, referred to as a "pillowcase," which contains a soft cushioning material. The soft cushioning material typically comprises synthetic or natural fiber material, down feathers, or a synthetic foam material.

The inventor of the present invention has also previously invented various cushioning materials and cushions that include gelatinous elastomer materials. For example, the following patents disclose various gelatinous elastomer cushions: U.S. Pat. No. 5,749,111 issued May 12, 1998 to Pearce, U.S. Pat. No. 6,026,527 issued Feb. 22, 2000 to Pearce, U.S. Pat. No. 6,413,458 issued Jul. 2, 2002 to Pearce, and U.S. Pat. No. 8,919,750 issued Dec. 30, 2014 to Pearce et al., the disclosures of which are hereby incorporated herein in their entireties by this reference.

BRIEF SUMMARY

In some embodiments, the present disclosure includes a pillow comprising a pillow cushion and a pillow cover covering the pillow cushion. The pillow cushion consists essentially of a gelatinous elastomer. The pillow cushion is sized and configured to support a head and neck of a person using the pillow cushion. The pillow cushion comprises a first major surface, a second major surface, and deformable wall members extending between the first major surface and the second major surface. The deformable wall members are located and configured to define voids therebetween such that the deformable wall members may be displaced into adjacent voids upon deformation of the deformable wall members. The deformable wall members are configured to buckle when a pressure applied to a cushioning surface of the pillow cushion, in a direction perpendicular to the first major surface, exceeds a threshold pressure level.

In additional embodiments, the present disclosure includes methods of fabricating a pillow. A pillow cushion is formed that consists essentially of a gelatinous elastomer. The pillow cushion is sized and configured to support a head and neck of a person using the pillow cushion, and comprises a first major surface, a second major surface, and deformable wall members extending between the first major surface and the second major surface. The deformable wall members are located and configured to define voids therebetween such that the deformable wall members may be displaced into adjacent voids upon deformation of the deformable wall members. The deformable wall members are configured to buckle when a pressure applied to a cushioning surface of the pillow cushion, in a direction perpendicular to the first major surface, exceeds a threshold pressure level. After forming the pillow cushion, the pillow cushion is enclosed within a pillow cover.

BRIEF DESCRIPTION OF THE DRAWINGS

While the specification concludes with claims particularly pointing out and distinctly claiming what are regarded as embodiments of the present invention, various features and advantages of embodiments of the disclosure may be more readily ascertained from the following description of example embodiments when read in conjunction with the accompanying drawings, in which:

DETAILED DESCRIPTION

As used herein, the term "elastomeric polymer" means and includes a polymer capable of recovering its original size and shape after deformation. In other words, an elastomeric polymer is a polymer having elastic or viscoelastic properties. Elastomeric polymers may also be referred to as "elastomers" in the art. Elastomeric polymers include, without limitation, homopolymers (polymers having a single chemical unit repeated) and copolymers (polymers having two or more chemical units).

The illustrations presented herein are not actual views of any particular pillow, pillow cushion, pillow insert, or pillow cover, but are merely idealized representations employed to describe embodiments of the present disclosure. Elements common between figures may retain the same numerical designation.

Figure 1:
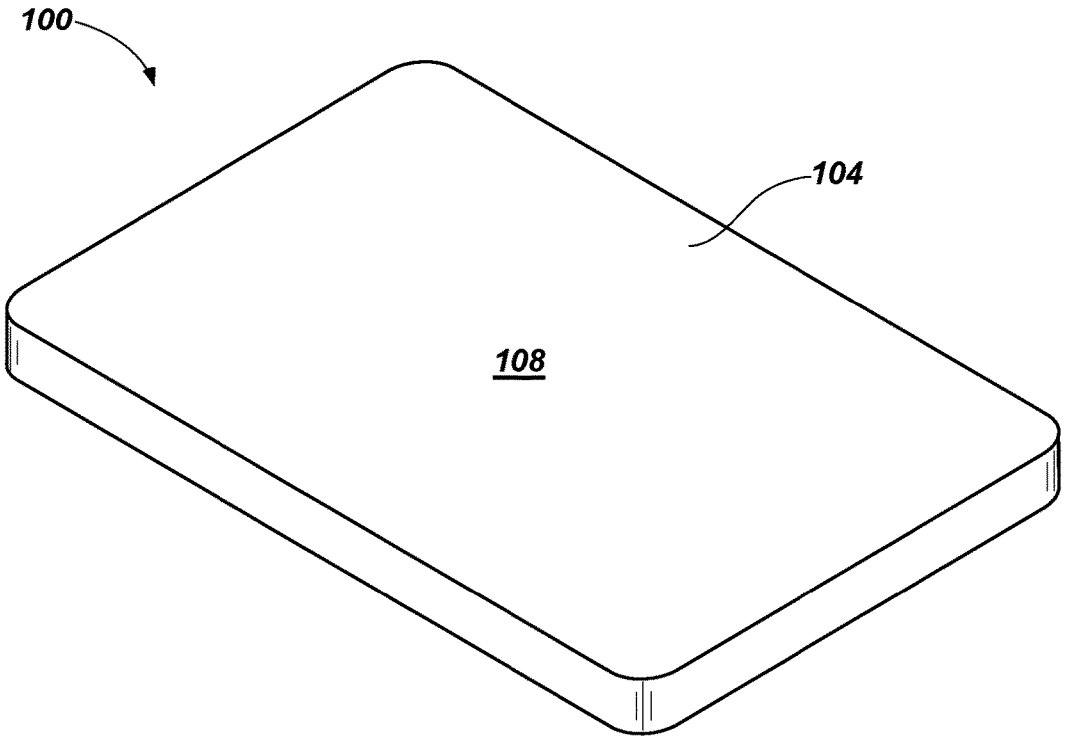
FIG. 1 is a top perspective view of an embodiment of a pillow of the present disclosure.
Figure 2:
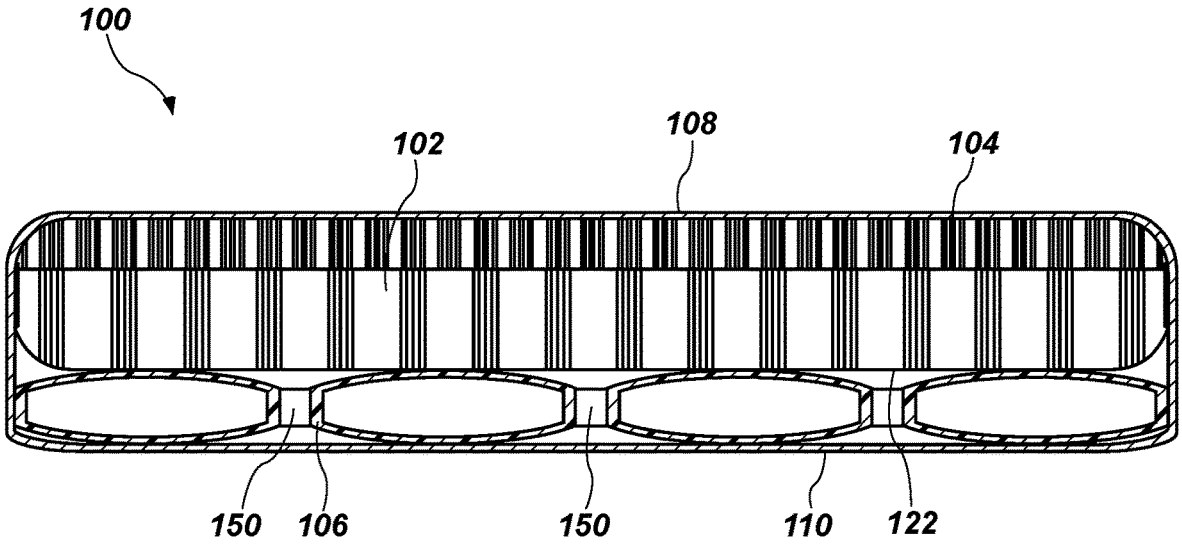
FIG. 2 is a cross-sectional side view of the pillow of FIG. 1.

FIG. 1 illustrates an embodiment of a pillow 100 of the present disclosure in perspective view. FIG. 2 is a cross-sectional view of the pillow 100. As shown in FIG. 2, the pillow 100 includes a pillow cushion 102 and a pillow cover 104 covering the pillow cushion 102. The pillow 100 optionally may further include an insert 106, as discussed in further detail subsequently herein. In other words, the insert 106 may be excluded in some embodiments, such that pillow 100 consists of the pillow cushion 102 and the pillow cover 104. The pillow 100 and pillow cushion 102 are sized and configured to support a head and neck of a person using the pillow 100.

The pillow cushion 102 consists essentially of a gelatinous elastomer (also referred to in the art as "elastomer gels," "gelatinous elastomers," or simply "gels"). In some embodiments, the pillow cushion 102 may comprise 90% by weight or more, 95% by weight or more, 98% by weight or more, or even 100% by weight gelatinous elastomer. Gelatinous elastomers are elastomeric materials, which may include elastomeric polymers or mixtures of elastomeric polymers and plasticizers (and optionally other materials such as pigments, fillers, antioxidants, etc.). Gelatinous elastomers are elastic (i.e., capable of recovering size and shape after deformation).

For example, the gelatinous elastomer of the pillow cushion 102 may comprise a mixture of an elastomeric block copolymer and a plasticizer. As used herein, the term "elastomeric block copolymer" means and includes an elastomeric polymer having groups or blocks of homopolymers linked together, such as A-B diblock copolymers and A-B-A triblock copolymers. A-B diblock copolymers have two distinct blocks of homopolymers. A-B-A triblock copolymers have two blocks of a single homopolymer (A) each linked to a single block of a different homopolymer (B). As used herein, the term "plasticizer" means and includes a substance added to another material (e.g., an elastomeric polymer) to increase a workability of the material. For example, a plasticizer may increase the flexibility, softness, or extensibility of the material. Plasticizers include, without limitation, hydrocarbon fluids, such as mineral oils. Hydrocarbon plasticizers may be aromatic or aliphatic.

As non-limiting examples, the pillow cushion 102 may comprise a gelatinous elastomer as described in U.S. Pat. No. 5,994,450, issued Nov. 30, 1999, and titled "Gelatinous Elastomer and Methods of Making and Using the Same and Articles Made Therefrom"; U.S. Pat. No. 7,964,664, issued Jun. 21, 2011, and titled "Gel with Wide Distribution of MW in Mid-Block"; and U.S. Pat. No. 4,369,284, issued Jan. 18, 1983, and titled "Thermoplastic Elastomer Gelatinous Compositions"; the disclosures of each of which are incorporated herein in their entirety by this reference.

The elastomeric block polymer of the gelatinous elastomer may be an A-B-A triblock copolymer such as styrene ethylene propylene styrene (SEPS), styrene ethylene butylene styrene (SEBS), or styrene ethylene ethylene propylene styrene (SEEPS). For example, A-B-A triblock copolymers commercially available from Kuraray America, Inc., of Houston, TX, under the trade name SEPTON® 4055, and from Kraton Polymers, LLC, of Houston, TX, under the trade names KRATON® E1830, KRATON® G1650, and KRATON® G1651 may be employed in the gelatinous elastomer. In these examples, the "A" blocks are styrene. The "B" block may be rubber (e.g., butadiene, isoprene, etc.) or hydrogenated rubber (e.g., ethylene/propylene or ethylene/butylene or ethylene/ethylene/propylene) capable of being plasticized with mineral oil or other hydrocarbon fluids. The gelatinous elastomer may include elastomeric polymers other than styrene-based copolymers, such as non-styrenic elastomeric polymers that are thermoplastic in nature or that can be solvated by plasticizers or that are multi-component thermoset elastomers. Other elastomeric polymers that may be employed include polymers that are derivatives of these families of synthetic rubber polymers, or that exhibit similar physical properties to such synthetic rubber polymers.

The gelatinous elastomer may include one or more plasticizers, such as hydrocarbon fluids. For example, elastomeric materials may include aromatic-free food-grade white paraffinic mineral oils, such as those sold by Sonneborn, Inc., of Mahwah, NJ, under the trade names BLANDOL® and CARNATION®.

As one particular non-limiting example, the gelatinous elastomer of the pillow cushion 102 may include a melt-blend of one part by weight of a styrene-ethylene-ethylene-propylene-styrene (SEEPS) elastomeric triblock copolymer (e.g., SEPTON® 4055) with four parts by weight of a 70-weight straight-cut white paraffinic mineral oil (e.g., CARNATION® white mineral oil) and, optionally, pigments, antioxidants, and/or other additives.

The gelatinous elastomer may include one or more fillers (e.g., lightweight microspheres). Fillers may affect thermal properties, density, processing, etc., of the elastomeric material. For example, hollow microspheres (e.g., hollow glass microspheres or hollow acrylic microspheres) may decrease the thermal conductivity of the elastomeric material by acting as an insulator because such hollow microspheres (e.g., hollow glass microspheres or hollow acrylic microspheres) may have lower thermal conductivity than the plasticizer or the polymer.

The gelatinous elastomer may also include antioxidants. Antioxidants may reduce the effects of thermal degradation during processing or may improve long-term stability. Antioxidants include, for example, pentaerythritol tetrakis(3-(3,5-di-tert-butyl-4-hydroxyphenyl) propionate), commercially available as IRGANOX® 1010, from BASF Corp., of Iselin, NJ or as EVERNOX®-10, from Everspring Chemical, of Taichung, Taiwan; octadecyl-3-(3,5-di-tert-butyl-4-hydroxyphenyl)propionate, commercially available as IRGANOX® 1076, from BASF Corp. or as EVERNOX® 76, from Everspring Chemical; and tris(2,4-di-tert-butylphenyl)phosphite, commercially available as IRGAFOS® 168, from BASF Corp. or as EVERFOS® 168, from Everspring Chemical. One or more antioxidants may be combined in a single formulation of the gelatinous elastomer. The use of antioxidants in mixtures of plasticizers and polymers is described in columns 25 and 26 of U.S. Pat. No. 5,994,450, previously incorporated by reference. The gelatinous elastomer may include up to about 5% by weight antioxidants. For instance, the gelatinous elastomer may include from about 0.10% by weight to about 1.0% by weight antioxidants.

In some embodiments, the gelatinous elastomer may include a pigment or a combination of pigments so as to provide the pillow cushion 102 with an appearance that is appealing to consumers. As one non-limiting example, the pigment may create a soothing color, which may be purple or lavender.

The gelatinous elastomer of the pillow cushion 102 is elastic in that it returns to its original shape after deformation, and may be elastically stretched and compressed. The gelatinous elastomer may be rubbery in feel, but may deform to the shape of an object applying a deforming pressure better than conventional rubber materials, and may have a durometer hardness lower than conventional rubber materials. For example, the gelatinous elastomer may have a hardness on the Shore A scale of from about 0.1 to about 50, and in some embodiments, less than about 5. The gelatinous elastomer is soft enough to not cause pain or discomfort to the ear or other facial parts of a person sleeping or resting their head on the pillow 100.

The gelatinous elastomer may be generally nonsticky, such that the pillow cushion 102 may return to its original shape after deformation. In some embodiments, the pillow cushion 102 may comprise between about six pounds and twelve pounds of the gelatinous elastomer. As one non-limiting example, the cushion may have a length of about twenty-four inches, a width of about sixteen inches, and a height or thickness of about three and one-half inches.

As shown in FIG. 2, the pillow 100 may not include any additional cushioning material between the pillow cushion 102 and the pillow cover 104. The pillow cover 104 includes an upper first major side 108 and an opposing lower second major side 110.

Figure 3:
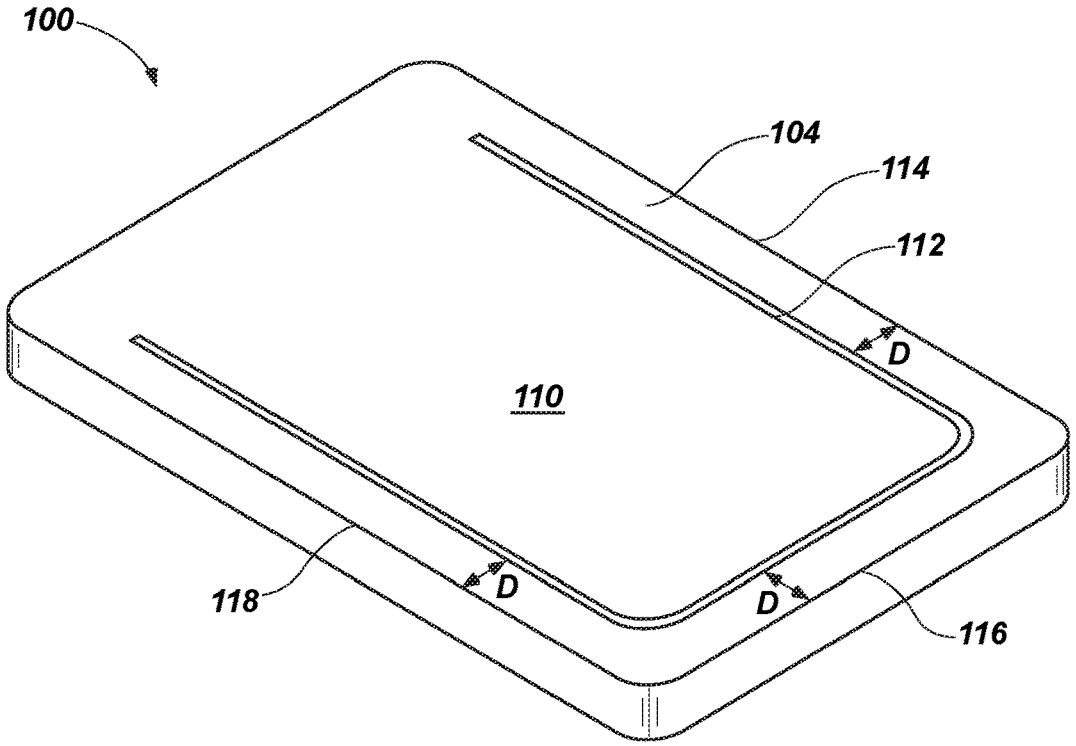
FIG. 3 is a bottom perspective view of the pillow of FIG. 1.

FIG. 3 is a perspective view of the pillow 100 illustrating the lower second major side 110 of the pillow cover 104. As shown therein, the pillow cover 104 may include a zipper 112 disposed on the lower second major side 110 of the pillow cover 104. The zipper 112 may be entirely located a distance D of at least one inch from peripheral edges of the lower second major side 110 of the pillow cover 104. For example, the distance D may be between about one inch and about three inches.

As shown in FIG. 3, the zipper 112 of the pillow cover 104 may extend proximate and along at least a portion of a first longitudinal peripheral edge 114 of the pillow cover 104, proximate and along a first lateral peripheral edge 116 of the pillow cover 104, and proximate and along at least a portion of a second longitudinal peripheral edge 118 of the pillow cover 104. By extending the zipper 112 around multiple sides of the pillow cover 104, the pillow cushion 102 and optional insert 106 may be easily inserted into and removed from the pillow cover 104. Furthermore, by locating the zipper 112 a distance D from the peripheral edges of the lower second major side 110 of the pillow cover 104, the zipper 112 is less likely to be disposed adjacent the body of a person using the pillow 100, or otherwise felt by the user.

The zipper 112 may extend proximate and along three sides of the pillow cover 104 as shown in FIG. 3, or, in other embodiments, proximate and along four sides of the pillow cover 104, or proximate and along an entirety of one side and proximate and along only portions of two adjacent sides. In yet further embodiments, the zipper 112 may extend proximate and along an entirety of one side and proximate and along only a portion of one adjacent side. Any other location and configuration of the zipper 112 that facilitates insertion and removal of the cushion 102 and optional insert 106 may also be employed. A fabric (e.g., a non-slip fabric) may be provided on the interior of the zipper 112.

In other embodiments, any other type of fastener, such as hook-and-loop material, may be used instead of a zipper 112 to securely close an aperture in the lower second major side 110 of the pillow cover 104.

In use, the pillow 100 with the pillow cover 104 thereon optionally may be inserted into a conventional linen pillowcase.

Figure 4:
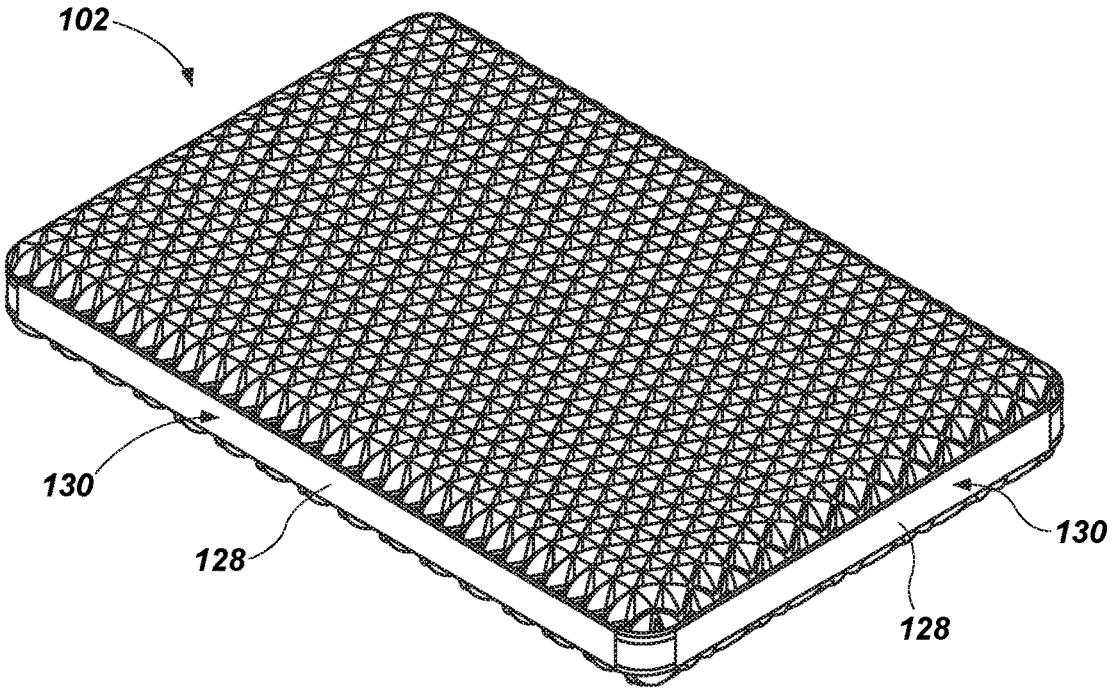
FIG. 4 is a perspective view of an embodiment of a pillow cushion of the pillow of FIG. 1.
Figure 5:
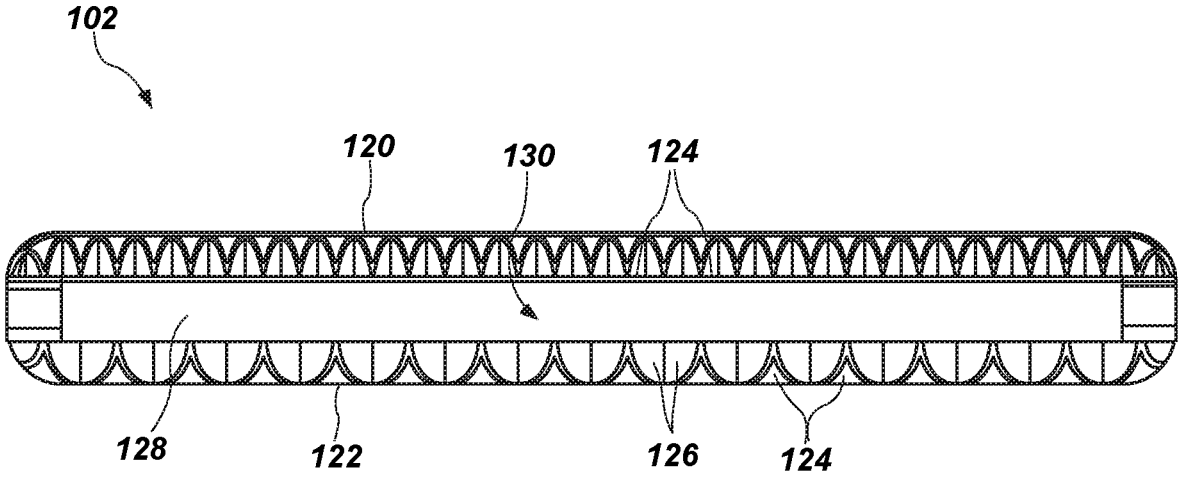
FIG. 5 is a front side view of the pillow cushion of FIG. 4.
Figure 6:
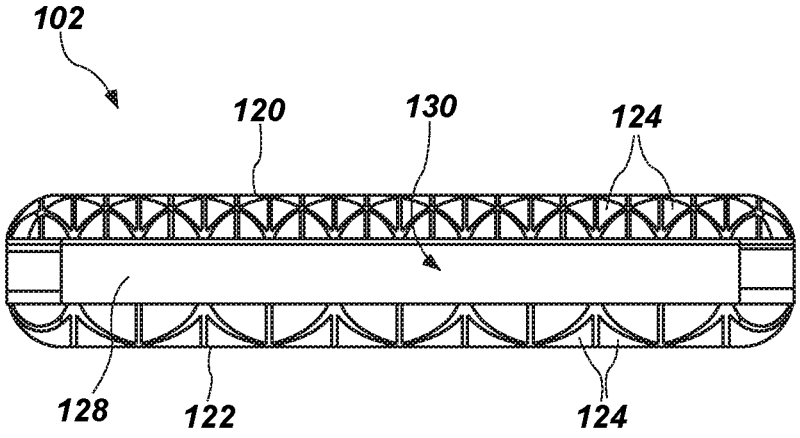
FIG. 6 is a lateral side view of the pillow cushion of FIG. 4.

The pillow cushion 102 is illustrated in FIGS. 4 through 9. FIG. 4 is a perspective view of the pillow cushion 102. As shown in FIG. 4, the cushion 102 has radiused peripheral edges on the upper and lower sides of the cushion 102. The radius of the peripheral edges may be from about 0.25 inch to about 5.0 inches. As shown in FIGS. 5 and 6, the pillow cushion 102 has a first major surface 120 and an opposing second major surface 122, and includes deformable wall members 124 extending between the first major surface 120 and the second major surface 122. The first major surface 120 and the second major surface 122 are defined by ends of the deformable wall members 124 collectively.

The deformable wall members 124 are located and configured to define voids 126 therebetween such that the deformable wall members 124 may be displaced into adjacent voids 126 upon deformation of the deformable wall members 124. Furthermore, the deformable wall members 124 are configured to buckle when a pressure applied to a cushioning surface of the pillow cushion 102 (i.e., the first major surface 120), in a direction perpendicular to the first major surface 120, exceeds a threshold pressure level.

Figure 7:
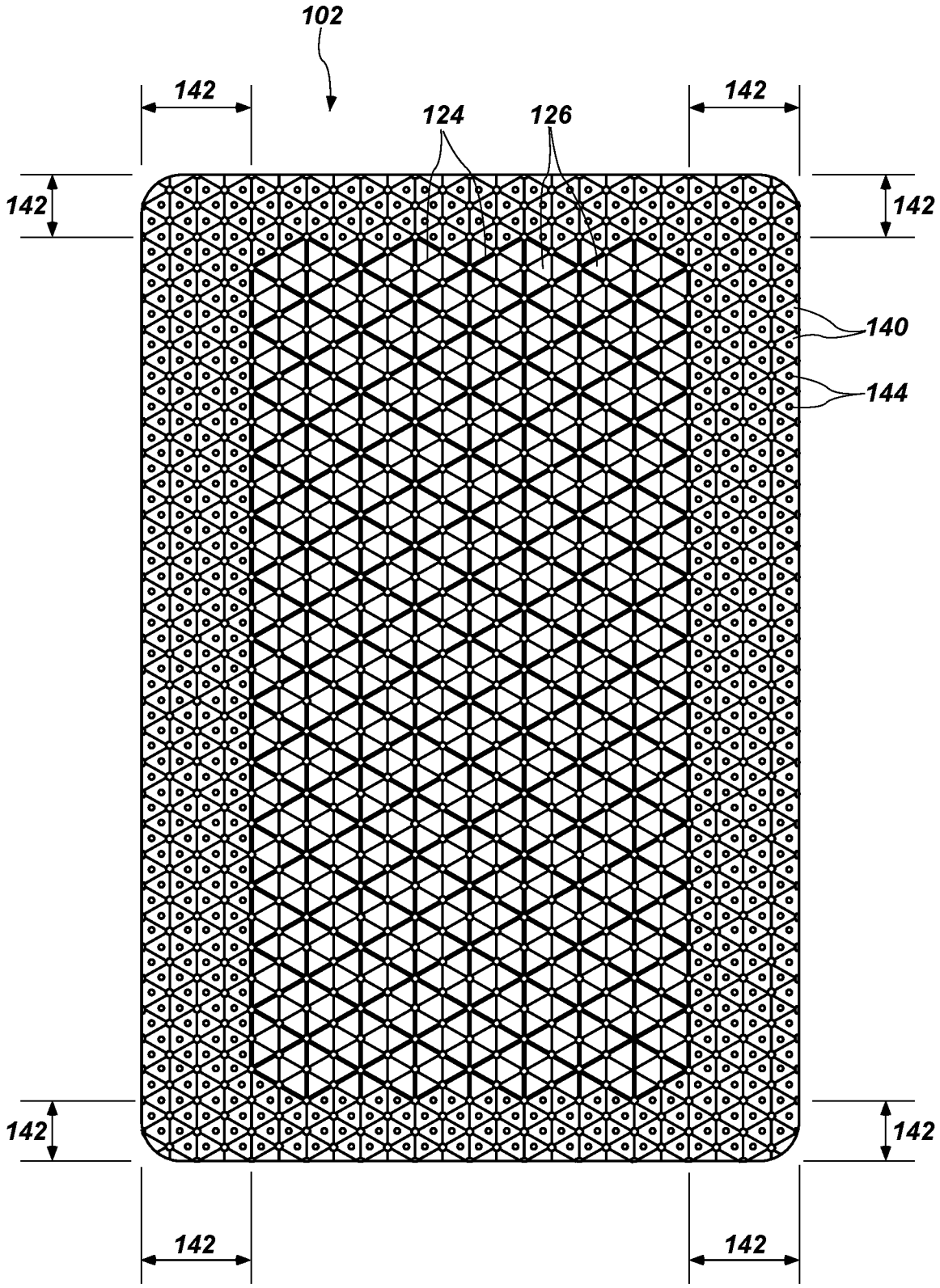
FIG. 7 is a top plan view of the pillow cushion of FIG. 4.
Figure 8:
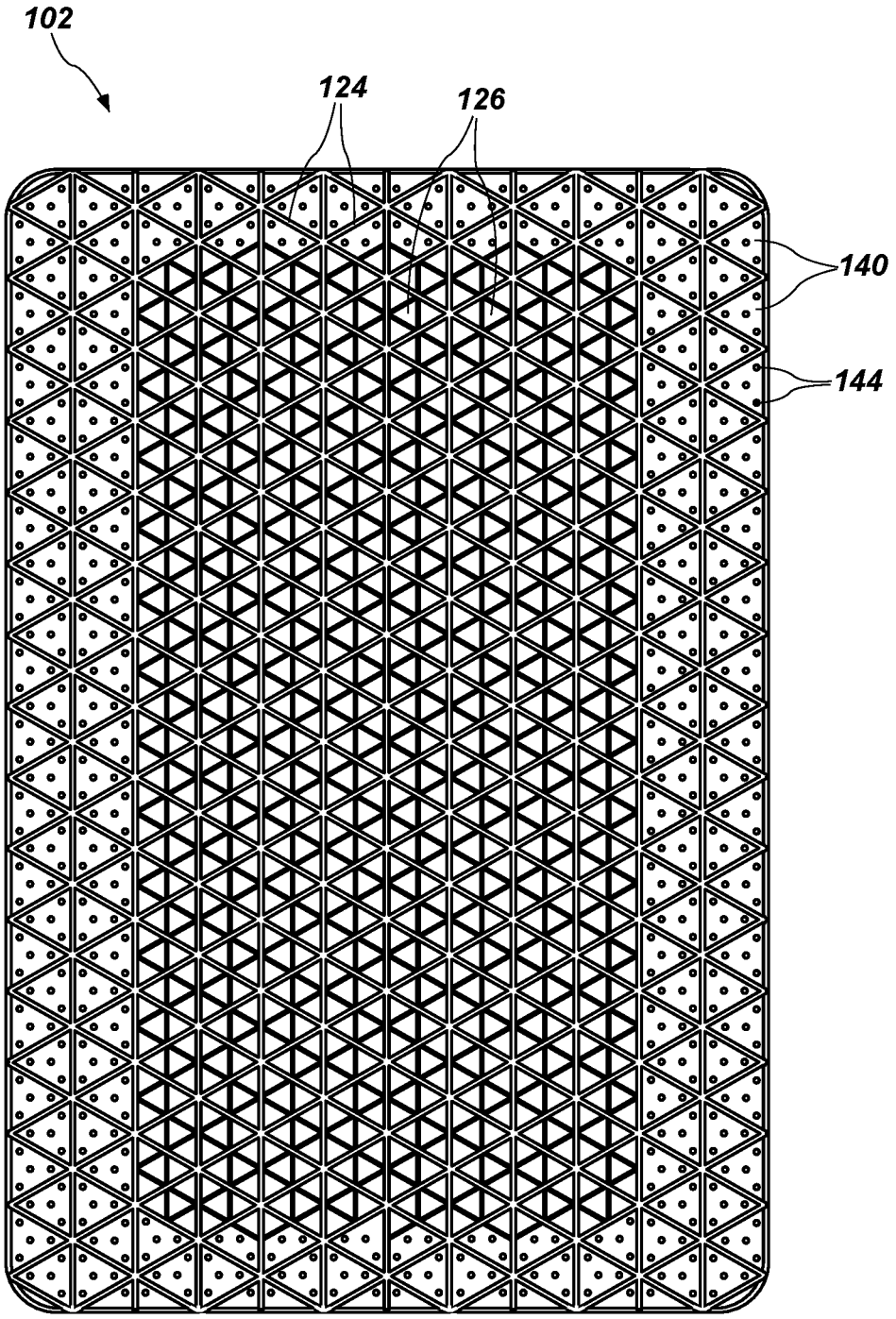
FIG. 8 is a bottom plan view of the pillow cushion of FIG. 4.

As shown in the plan views of FIGS. 7 and 8, in some embodiments, the deformable wall members 124 may be located and configured to define triangular voids 126 therebetween. In other words, the voids 126 may have a cross-sectional shape in a cross-sectional plane parallel to the first major surface 120 and the second major surface 122 (FIGS. 5 and 6). The triangular shape of the columnar voids 126 provides the cushion 102 with improved stability in the lateral direction. In other embodiments, however, the voids 126 may have any other desired shape (e.g., rectangular, pentagonal, hexagonal, etc.).

In the configuration described herein, the gelatinous elastomer of the cushion 102 is formed into the deformable wall members 124, which define hollow columns with shared walls that behave like a spring under pressure unless the localized pressure exceeds a threshold pressure, at which time one or more of the hollow columns buckles and the load is spread out to a larger area encompassing surrounding columns. This mechanism provides enhanced comfort, while not being so soft as to not be supportive to the neck and head so as to preserve desired spinal alignment, and not being so soft as to allow the nose of person sleeping or resting on their side to be smothered by sinking too far into the pillow 100.

Referring again to FIGS. 4 through 6, the pillow cushion 102 may further include a band 128 of the gelatinous elastomer that extends at least partially around the periphery of the cushion 102 at lateral side surfaces 130 of the cushion 102. The band 128 may be integrally formed with the cushion 102. In some embodiments, the band 128 may define an entirety of the lateral side surfaces 130 of the cushion 102 between the radiused peripheral edges on the top and bottom major sides of the cushion 102, as shown in FIGS. 5 and 6. The band 128 of the gelatinous elastomer may also improve the lateral stability of the cushion 102, at least in peripheral regions of the cushion 102. The band 128 may comprise or define the outer wall of each of the triangular column voids 126 disposed at the outer periphery of the cushion 102, as shown in FIGS. 7 and 8.

Figure 9:
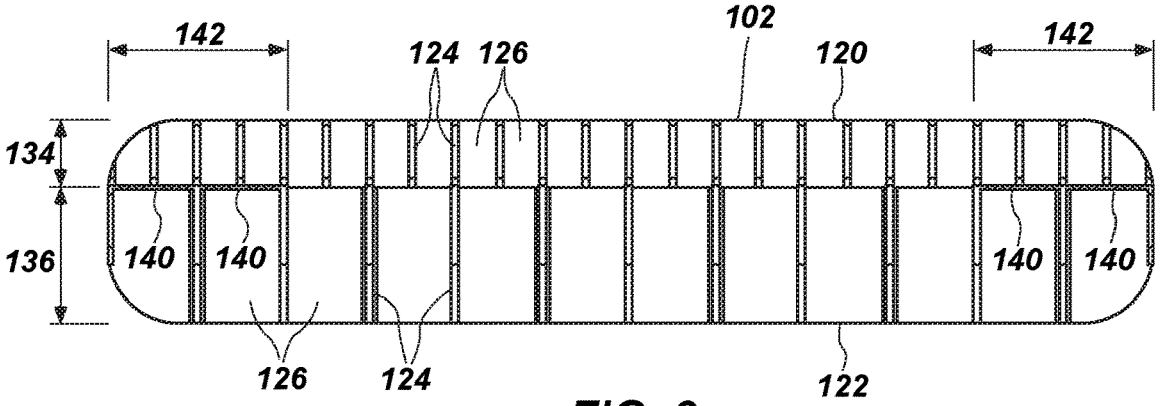
FIG. 9 is a cross-sectional side view of the pillow cushion of FIG. 4.

FIG. 9 is a cross-sectional side view of the pillow cushion 102. As shown therein, in some embodiments, the pillow cushion 102 may comprise a generally planar first portion 134, and a generally planar second portion 136 coupled with the first portion 134. Each of the first portion 134 and the second portion 136 has a top first major side and an opposite, bottom second major side. Each of the first portion 134 and the second portion 136 further includes a portion of the deformable wall members 124 extending between the first major sides and the opposite second major sides of the first portion 134 and the second portion 136, respectively. The deformable wall members 124 of the first portion 134 and the deformable wall members 124 of the second portion 136 may be part of a single, unitary body comprising the gelatinous elastomer, as previously described herein.

The deformable wall members 124 in the generally planar first portion 134 are located and configured such that the voids 126 defined therebetween have a first average size, and the deformable wall members 124 in the generally planar second portion 136 are located and configured such that the voids 126 defined therebetween have a second average size. In some embodiments, the first average size may be smaller than the second average size. In other words, the voids 126 in the first portion 134 may have a smaller cross-sectional area in a plane parallel to the first major surface 120 than the voids 126 in the second portion 136, as shown in FIG. 9. For example, the voids 126 in the first portion 134 may have a cross-sectional area in a plane parallel to the first major surface 120 of between about 0.15 square inch and about 2.0 square inches, and the voids 126 in the second portion 136 may have a cross-sectional area in a plane parallel to the first major surface 120 that is between about two (2) times and about six (6) times the cross-sectional area of the voids 126 in the first portion 134. As one particular non-limiting embodiment, the voids 126 in the first portion 134 may have a cross-sectional area in a plane parallel to the first major surface 120 of 0.20 square inch, and the voids 126 in the second portion 136 may have a cross-sectional area in a plane parallel to the first major surface 120 of 0.8 square inch.

In some embodiments, the first portion 134 may include from two to six times (e.g., four times) as many voids 126 as are present in the second portion 136. Furthermore, the deformable wall members 124 in the first portion 134 may be thinner than the deformable wall members 124 in the second portion 136. By way of example and not limitation, the deformable wall members 124 in the first portion 134 may have a thickness that is between about 25% and about 75% (e.g., about 50%) of the thickness of the deformable wall members 124 in the second portion 136.

The first portion 134 may have a first average thickness (in the direction perpendicular to the first major surface 120), and the second portion 136 may have a second average thickness different from the first average thickness. For example, the first portion 134 may be thinner than the second portion 136 in the direction perpendicular to the first major surface 120, as shown in FIG. 9. Thus, the voids 126 in the first portion 134 may be shorter in the dimension perpendicular to the first major surface 120 than the voids 126 in the second portion 136.

Furthermore, the deformable wall members 124 in the first portion 134 may be configured to buckle when a pressure applied to a cushioning surface of the pillow cushion 102 (i.e., the first major surface 120) in the direction perpendicular to the first major surface 120 exceeds a first threshold pressure level, and the deformable wall members 124 in the second portion 136 are configured to buckle when a pressure applied to the cushioning surface of the pillow cushion 102 in the direction perpendicular to the first major surface 120 exceeds a second threshold pressure level that is different than the first threshold pressure level. In such a configuration, the cushion 102 may exhibit a dual-stage buckling property.

In additional embodiments, more than two layers of buckling columns defined by deformable wall members 124 and voids 126 may be employed, and the threshold buckling pressure level may vary amongst each of the layers so as to cause the cushion 102 to exhibit a multi-stage (e.g., three or more stages) buckling property.

In yet further embodiments, the cushion 102 may comprise a single layer of buckling columns defined by deformable wall members 124 and voids 126 extending continuously between the first major surface 120 and the second major surface 122, such that the cushion 102 exhibits a single-stage buckling property.

As shown in FIG. 7, the deformable wall members 124 in the first portion 134 (FIG. 9) are located and configured to define a first set of triangular voids 126 therebetween. As shown in FIG. 8, the deformable wall members 126 in the second portion 134 (FIG. 9) also may be located and configured to define a second set of triangular voids 126 therebetween. At least some of the first set of triangular voids 126 in the first portion 134 may be misaligned with the second set of triangular voids 126 in the second portion 136 in the direction perpendicular to the first major surface 120 of the cushion 102. In other words, the central axis of at least some of the voids 126 in the first portion 134 may not be colinear with respective central axis of voids 126 in the second portion 136. In some embodiments, however, some of the voids 126 in the first portion 134 may be aligned with voids 126 in the second portion 136.

As shown in FIGS. 7, 8, and 9, the cushion 102 may include a stabilizing layer 140 in some embodiments. The stabilizing layer 140 may comprise an integral portion of the gelatinous elastomer that extends horizontally within the cushion 102 and that is located between the first major surface 120 and the second major surface 122 in a direction generally parallel to at least one of the first major surface 120 and the second major surface 122 of the cushion 102. The stabilizing layer 140 of the gelatinous elastomer may be disposed in peripheral regions 142 (FIGS. 7 and 9) of the cushion 102 and not disposed in a central region of the cushion 102. The cushion 102 may be fabricated using a molding process, and the stabilizing layer 140 may be formed at the mold parting line, which is at the interface between the first portion 134 and the second portion 136. For example, the first and second portions 134, 136 may be formed by molding gelatinous elastomer in a cavity of a mold (e.g., a bi-part mold having two mold halves) to form a single, unitary body of the gelatinous elastomer.

The stabilizing layer 140 may cause the peripheral regions 142 of the cushion 102, which support the neck of a person using the pillow 100, to be relatively firmer or stiffer (and more supportive) than the central region of the cushion 102, which supports the head of the user. This has an orthopedic shaping effect without having to make the un-deformed pillow shaped so as to have a three-dimensional contour under the neck and the head. Furthermore, the stabilizing layer 140 increases the side-load stiffness around the periphery of the cushion 102, which helps the pillow 100 keep, or rebound to, its un-deformed shape after deformation.

In additional embodiments, the stabilizing layer 140 may extend continuously across the entire area of the cushion 102 through the peripheral regions 142 and the central region of the cushion 102.

Apertures 144 may extend through the stabilizing layer 140 of the gelatinous elastomer so as to allow air flow through the stabilizing layer 140 between voids 126 on opposing sides of the stabilizing layer 140, as shown in FIGS. 7 and 8. The apertures 144 enhance breathability of the cushion.

In some embodiments, the pillow cushion 102 of the pillow 100 may be free of foam and/or fiber cushioning material.

In some embodiments, a non-cushioning fabric may be fused to the second major surface 122 of the cushion 102, so as to improve the lateral stability of the cushion 102 and ensure that the pillow 100 will keep, or rebound to, its un-deformed shape after deformation. The fabric may comprise a non-stretchable fabric that is heat-fused to the second major surface 122 of the cushion 102. A non-stretchable woven fabric may be employed, though any fabric may be used including non-woven fabric, stretchy fabric, or woven fabric that has little to no stretch.

As previously mentioned, there may be no additional cushioning material between the cushion 102 and the pillow cover 104. The pillow cover 104 may comprise, for example, a stretchable knit material with a small amount (e.g., ⅛" thick) of loft, in a weight of about 400 grams/$m^2$. Such a material is sufficient to dampen the feel on the ear or the face of the user of the deformable wall members 124 of the cushion 102, so that the pillow 100 feels smooth to the face, ear, and/or head of the user. The pillow cover 104 may comprise any fabric, fabric laminate, multi-layer knit fabric, or spacer fabric with sufficient body, weight, and/or loft to substantially eliminate the feeling of, or ability of the user to feel the deformable wall members 124 and voids 126 on the user's face, ear, or head. Furthermore, the pillow cover 104 may comprise a stretchable fabric so as to not interfere with the soft, pressure-redistributing buckling hollow columns of the pillow cushion 102. In some embodiments, only the pillow cover 104 is between the soft gel columnar material of the pillow cushion 102 and the head or face of the user, and no other intermediate material may be present. In some embodiments, however, a thin, stretchy inner cover for the cushion 102 may be present to avoid the gelatinous material of the cushion 102 becoming dirty when removed from the pillow cover 104 for laundering of the pillow cover 104. Such a material, however, may not have a thickness intended to dampen the feel of the buckling hollow columns of the cushion 102.

Figure 10:
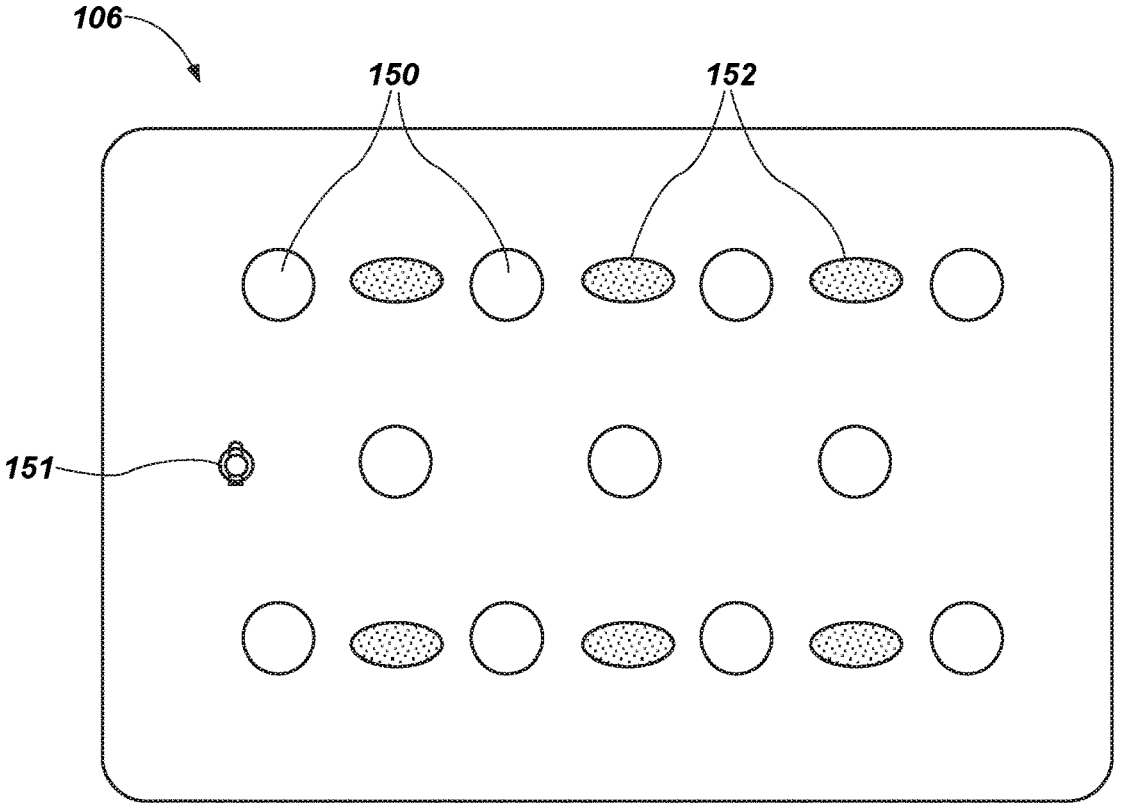
FIG. 10 is a top plan view of an embodiment of an optional insert of the pillow of FIG. 1.

The optional insert 106 is shown in the cross-sectional view of FIG. 2 and the plan view of FIG. 10. As shown therein, the insert 106 may be disposed between the second major surface 122 of the cushion 102 and an inner surface of the pillow cover 104 so as to increase a thickness of the pillow 100. The insert 106 may comprise any material. In the embodiment of FIGS. 2 and 10, the insert 106 comprises an inflatable bladder configured to be inflated and/or deflated with air so as to adjust a thickness of the insert 106, and, hence, the pillow 100.

Since the pillow cushion 102 is molded to a specific height (or thickness), and users may prefer a different height, the optional insert 106 may be used to increase the overall height of the pillow 100. The inflatable air bladder can be adjusted to multiple heights by insertion of more or less air through a mouth-inflatable air valve 151 (FIG. 10). Alternatively, a hand-operable or electric-pump-operable valve may be employed. A simple bladder made by welding (e.g., with radio frequency welding or thermal welding) two layers of plastic together may be used. For example, a top layer of plastic and a bottom layer of plastic may be joined by a side gusset piece of plastic. In some embodiments, the top layer can be slightly larger than the bottom layer, which results in the gusset not being vertical, so as to better conform to the shoulder of a person using the pillow and resting on the user's side. The plastic can be laminated to or coated with a flocking fiber, or with fabric, to quiet noise generated upon deforming the plastic, and to provide friction against the pillow cover 104 or the cushion 102 to secure the insert 106 in place. As one non-limiting example, flocked polyvinylchloride (PVC) film may be employed.

As shown in FIG. 10, the insert 106 may have apertures 150 (see also FIG. 2) extending therethrough between a first side of the insert 106 adjacent the cushion 102 (FIG. 2) and an opposing second side of the insert 106 adjacent the pillow cover 104 (FIG. 2). For example, the plastic of the air bladder may include welded holes in the interior region of the air bladder to allow air flow through the insert 106. The insert 106 may be attachable to the pillow cover 104 and/or to the cushion 102 (e.g., to a fabric heat-fused to the cushion) using, for example, hook-and-loop material 152. In other embodiments, snaps, buttons, or the like may be used to secure the insert 106 to the pillow cover 104 and/or the cushion 102. In other embodiments, the insert 106 may simply be held in place against the cushion 102 by the pillow cover 104 without being otherwise attached to the cushion 102 or pillow cover 104.

The inflatable insert 106 may enhance the cushioning effect of the pillow 100, especially when the air bladder is only partially filled. In such case, the deformability of the insert 106 may add another degree of freedom of movement to the overall cushioning effect. The insert 106 has no effect on height or on cushioning if empty of air, and may be left in the pillow cover 104 or removed. If the air bladder is full to the point of tightness, the thickness of the pillow 100 is maximized, but the insert 106 contributes little to the cushioning effect of the pillow 100. When the air bladder of the insert 106 is between about one-quarter and three-quarters full of air, the insert 106 may significantly contribute to the cushioning effect of the pillow 100.

Figure 11:
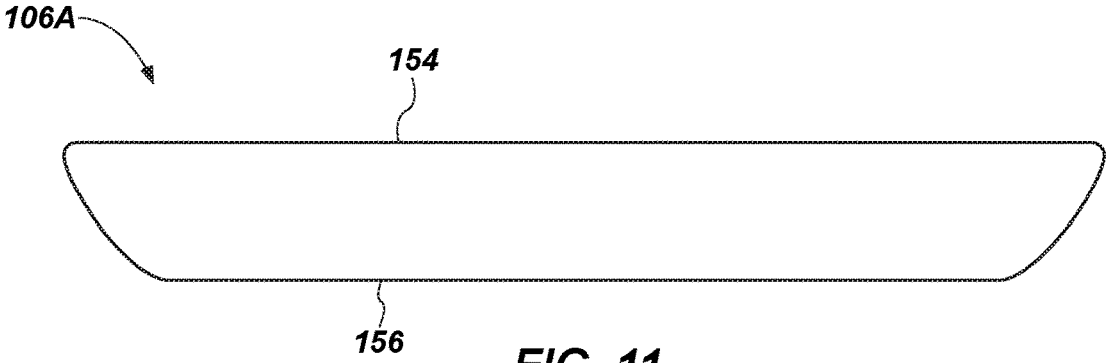
FIG. 11 is a side view of another embodiment of an optional insert of the pillow of FIG. 1.

FIG. 11 illustrates another embodiment of an insert 106A. The insert 106A simply comprises a body of foam. The insert 106A has a length on a side 154 of the insert 106A adjacent the cushion 102 (FIG. 2) greater than a length on a side 156 of the insert 106A adjacent the pillow cover 104 (FIG. 2), and a width on a side 154 of the insert 106A adjacent the cushion 106 greater than a width on a side 156 of the insert 106A adjacent the pillow cover 104.

In additional embodiments, the insert 106A may comprise a plurality of layers of foam, for example, several pieces of 0.75" thick foam, so that the user may put one or more layers of foam under the cushion 102 within the cover 104 so as to configure the pillow 100 with a desired thickness.

In yet further embodiments, bonded polyester fluff fiber, quilted fabric or three-dimensional knitted fabric (often referred to as "spacer fabric") may be employed as or in an optional insert.

A pillow 100 as described herein may be highly breathable due to the hollow buckling columns of the cushion 102, which reduces or eliminates build-up of sweat. The pillow 100 is temperature-neutral, not hot or cool to the touch. Furthermore, the pillow 100 is usable by a person sleeping on his or her side with a full-face CPAP mask, without making a feature of the pillow 100 to avoid contact with the CPAP mask (such as a side cut-out or an indentation as is classically used in pillows meant for use with CPAP masks).

Unlike traditional pillows that employ particulate cushioning media such as feathers, chopped-foam or shredded-foam, seed-hulls, etc., a pillow 100 as described herein will not lose shape over time during use. Loss of shape is a problem even with non-shredded/chopped pillows, such as memory foam pillows made all in one piece, because, as the body heats up the foam, the stiffness of the foam changes and the foam loses support and shape. A pillow 100 as described herein will retain its same shape and support all night long, and needs no adjustment (e.g., fluffing) during the night or before use on a subsequent night.

Additional non-limiting example embodiments of the disclosure are described below.

Embodiment 1: A pillow, comprising: a pillow cushion consisting essentially of a gelatinous elastomer, the pillow cushion sized and configured to support a head and neck of a person using the pillow cushion, the pillow cushion comprising: a first major surface; a second major surface; and deformable wall members extending between the first major surface and the second major surface, the deformable wall members located and configured to define voids therebetween such that the deformable wall members may be displaced into adjacent voids upon deformation of the deformable wall members, the deformable wall members configured to buckle when a pressure applied to a cushioning surface of the pillow cushion, in a direction perpendicular to the first major surface, exceeds a threshold pressure level; and a pillow cover covering the pillow cushion.

Embodiment 2: The pillow of Embodiment 1, wherein the pillow cushion comprises between six pounds and twelve pounds of the gelatinous elastomer.

Embodiment 3: The pillow of Embodiment 1, wherein the pillow does not include any additional cushioning material between the pillow cushion and the pillow cover.

Embodiment 4: The pillow of Embodiment 3, wherein the pillow consists of the pillow cushion and the pillow cover.

Embodiment 5: The pillow of Embodiment 1, wherein the pillow cushion further comprises: a generally planar first portion; and a generally planar second portion coupled with the first portion, wherein each of the first portion and the second portion comprises: a first major side; an opposite second major side; and a portion of the deformable wall members extending between the first major side and the opposite second major side; wherein the deformable wall members in the generally planar first portion are located and configured such that the voids defined therebetween have a first average size, and wherein the deformable wall members in the generally planar second portion are located and configured such that the voids defined therebetween have a second average size, the first average size being smaller than the second average size.

Embodiment 6: The pillow of Embodiment 5, wherein the deformable wall members of the first portion and the deformable wall members of the second portion are part of a single, unitary body.

Embodiment 7: The pillow of Embodiment 5, wherein the deformable wall members in the first portion are configured to buckle when a pressure applied to a cushioning surface of the pillow cushion in the direction perpendicular to the first major surface exceeds a first threshold pressure level, and wherein the deformable wall members in the second portion are configured to buckle when a pressure applied to a cushioning surface of the pillow cushion in the direction perpendicular to the first major surface exceeds a second threshold pressure level different than the first threshold pressure level.

Embodiment 8: The pillow of Embodiment 5, wherein the deformable wall members in the first portion are located and configured to define a first set of triangular voids therebetween, and wherein the deformable wall members in the second portion are located and configured to define a second set of triangular voids therebetween.

Embodiment 9: The pillow of Embodiment 8, wherein at least some of the first set of triangular voids are misaligned with all triangular voids of the second set of triangular voids in the direction perpendicular to the first major surface of the cushion.

Embodiment 10: The pillow of Embodiment 5, wherein the first portion has a first thickness, and the second portion has a second thickness different from the first thickness.

Embodiment 11: The pillow of Embodiment 1, wherein the deformable wall members are located and configured to define triangular voids therebetween.

Embodiment 12: The pillow of Embodiment 1, wherein the pillow cushion further comprises a band of the gelatinous elastomer extending entirely around a periphery of the cushion at lateral side surfaces of the cushion.

Embodiment 13: The pillow of Embodiment 1, further comprising a stabilizing layer of the gelatinous elastomer extending horizontally within the cushion between the first major surface and the second major surface in a direction generally parallel to at least one of the first major surface and the second major surface.

Embodiment 14: The pillow of Embodiment 13, wherein the stabilizing layer of the gelatinous elastomer is disposed in peripheral regions of the cushion and is not disposed in a central region of the cushion.

Embodiment 15: The pillow of Embodiment 14, further comprising apertures extending through the stabilizing layer of the gelatinous elastomer so as to allow air flow through the stabilizing layer between voids on opposing sides of the stabilizing layer.

Embodiment 16: The pillow of Embodiment 1, further comprising a fabric fused to the second major surface of the cushion.

Embodiment 17: The pillow of Embodiment 16, wherein the fabric comprises a non-stretchable fabric heat-fused to the second major surface of the cushion.

Embodiment 18: The pillow of Embodiment 1, further comprising an insert disposed between the second surface of the cushion and an inner surface of the pillow cover so as to increase a thickness of the pillow.

Embodiment 19: The pillow of Embodiment 18, wherein the insert comprises an inflatable bladder configured to be inflated and/or deflated with air so as to adjust a thickness of the pillow.

Embodiment 20: The pillow of Embodiment 18, wherein the insert has a length on a side of the insert adjacent the cushion greater than a length on a side of the insert adjacent the pillow cover, and a width on a side of the insert adjacent the cushion greater than a width on a side of the insert adjacent the pillow cover.

Embodiment 21: The pillow of Embodiment 18, wherein the insert further comprises apertures extending therethrough between a first side of the insert adjacent the cushion and an opposing second side of the insert adjacent the pillow cover.

Embodiment 22: The pillow of Embodiment 1, wherein the pillow case includes a zipper disposed on one major side of the pillow case, the zipper entirely located a distance of at least one inch from peripheral edges of the one major side of the pillow case.

Embodiment 23: The pillow of Embodiment 22, wherein the zipper of the pillow case extends proximate and along at least a portion of a first longitudinal peripheral edge of the pillow case, proximate and along a first lateral peripheral edge of the pillow case, and proximate and along at least a portion of a second longitudinal peripheral edge of the pillow case.

Embodiment 24: A method of fabricating a pillow, comprising: forming a pillow cushion consisting essentially of a gelatinous elastomer, the pillow cushion sized and configured to support a head and neck of a person using the pillow cushion, the pillow cushion comprising: a first major surface; a second major surface; and deformable wall members extending between the first major surface and the second major surface, the deformable wall members located and configured to define voids therebetween such that the deformable wall members may be displaced into adjacent voids upon deformation of the deformable wall members, the deformable wall members configured to buckle when a pressure applied to a cushioning surface of the pillow cushion, in a direction perpendicular to the first major surface, exceeds a threshold pressure level; and enclosing the pillow cushion in a pillow cover.

Embodiment 25: The method of Embodiment 24, wherein forming the pillow cushion comprises molding the pillow cushion.

Embodiment 26: The method of Embodiment 24, further comprising forming the deformable wall members of the first portion and the deformable wall members of the second portion to be part of a single, unitary body.

Embodiment 27: The method of Embodiment 24, wherein enclosing the pillow cushion in a pillow cover comprises enclosing the pillow cushion in the pillow cover without including any additional cushioning material between the pillow cushion and the pillow cover.

Embodiment 28: The method of Embodiment 24, wherein forming the pillow cushion further comprises forming the pillow cushion to comprise: a generally planar first portion; and a generally planar second portion coupled with the first portion, wherein each of the first portion and the second portion comprises: a first major side; an opposite second major side; and a portion of the deformable wall members extending between the first major side and the opposite second major side; wherein the deformable wall members in the generally planar first portion are located and configured such that the voids defined therebetween have a first average size, and wherein the deformable wall members in the generally planar second portion are located and configured such that the voids defined therebetween have a second average size, the first average size being smaller than the second average size.

Embodiment 29: The method of Embodiment 28, wherein forming the pillow cushion further comprises forming a single, unitary body comprising the deformable wall members of the first portion and the deformable wall members of the second portion.

Embodiment 30: The method of Embodiment 28, wherein forming the pillow cushion further comprises configuring the deformable wall members in the first portion to buckle when a pressure applied to a cushioning surface of the pillow cushion in the direction perpendicular to the first major surface exceeds a first threshold pressure level, and configuring the deformable wall members in the second portion to buckle when a pressure applied to the cushioning surface of the pillow cushion in the direction perpendicular to the first major surface exceeds a second threshold pressure level different than the first threshold pressure level.

Embodiment 31: The method of Embodiment 28, further comprising locating and configuring the deformable wall members in the first portion so as to define a first set of triangular voids therebetween, and locating and configuring the deformable wall members in the second portion so as to define a second set of triangular voids therebetween.

Embodiment 32: The method of Embodiment 31, further comprising misaligning the first set of triangular voids with the second set of triangular voids in the direction perpendicular to the first major surface of the cushion.

Embodiment 33: The method of Embodiment 28, wherein forming the pillow cushion further comprises forming the first portion to have a first thickness, and forming the second portion to have a second thickness different from the first thickness.

Embodiment 34: The method of Embodiment 24, wherein forming the pillow cushion further comprises locating and configuring the deformable wall members so as to define triangular voids therebetween.

Embodiment 35: The method of Embodiment 24, wherein forming the pillow cushion further comprises forming a band of the gelatinous elastomer extending entirely around a periphery of the cushion at lateral side surfaces of the cushion.

Embodiment 36: The method of Embodiment 24, wherein forming the pillow cushion further comprises forming a stabilizing layer of the gelatinous elastomer extending horizontally within the cushion between the first major surface and the second major surface in a direction generally parallel to at least one of the first major surface and the second major surface.

Embodiment 37: The method of Embodiment 36, wherein forming the pillow cushion further comprises disposing the stabilizing layer of the gelatinous elastomer in peripheral regions of the cushion and not in a central region of the cushion.

Embodiment 38: The method of Embodiment 37, wherein forming the pillow cushion further comprises forming apertures extending through the stabilizing layer of the gelatinous elastomer so as to allow air flow through the stabilizing layer between voids on opposing sides of the stabilizing layer.

Embodiment 39: The method of Embodiment 24, further comprising fusing a fabric to the second major surface of the cushion.

Embodiment 40: The method of Embodiment 39, further comprising selecting the fabric to comprise a non-stretchable fabric, and heat-fusing the non-stretchable fabric to the second major surface of the cushion.

Embodiment 41: The method of Embodiment 24, further comprising disposing an insert between the second surface of the cushion and an inner surface of the pillow cover so as to increase a thickness of the pillow.

Embodiment 42: The method of Embodiment 41, further comprising selecting the insert to comprise an inflatable bladder configured to be inflated and/or deflated with air so as to adjust a thickness of the pillow.

Embodiment 43: The method of Embodiment 41, wherein the insert has a length on a side of the insert adjacent the cushion greater than a length on a side of the insert adjacent the pillow cover, and a width on a side of the insert adjacent the cushion greater than a width on a side of the insert adjacent the pillow cover.

Embodiment 44: The method of Embodiment 41, wherein the insert further comprises apertures extending therethrough between a first side of the insert adjacent the cushion and an opposing second side of the insert adjacent the pillow cover.

Embodiment 45: The method of Embodiment 24, wherein the pillow case includes a zipper disposed on one major side of the pillow case, the zipper entirely located a distance of at least one inch from peripheral edges of the one major side of the pillow case.

Embodiment 46: The method of Embodiment 45, wherein the zipper of the pillow case extends proximate and along at least a portion of a first longitudinal peripheral edge of the pillow case, proximate and along a first lateral peripheral edge of the pillow case, and proximate and along at least a portion of a second longitudinal peripheral edge of the pillow case.

Embodiments of the disclosure are susceptible to various modifications and alternative forms. Specific embodiments have been shown in the drawings and described in detail herein to provide illustrative examples of embodiments of the disclosure. However, the disclosure is not limited to the particular forms disclosed herein. Rather, embodiments of the disclosure may include all modifications, equivalents, and alternatives falling within the scope of the disclosure as broadly defined herein. Furthermore, elements and features described herein in relation to some embodiments may be implemented in other embodiments of the disclosure, and may be combined with elements and features described herein in relation to other embodiments to provide yet further embodiments of the disclosure.

What is claimed:

1. A pillow, comprising:

a pillow cushion comprising a gelatinous elastomer, the pillow cushion comprising:

a stabilizing layer including a first side and a second side opposite from the first side;

first deformable wall members formed integrally with the stabilizing layer, extending from the first side of the stabilizing layer, including first ends defining a first major surface of the pillow cushion, and defining first voids over the first side of the stabilizing layer, the first voids opening to the first major surface, the first deformable wall members capable of being displaced into adjacent first voids upon deformation of the first deformable wall members, the stabilizing layer defining first ends of the first voids; and second deformable wall members formed integrally with the stabilizing layer, extending from the second side of the stabilizing layer, including second ends defining a second major surface of the pillow cushion opposite from the first major surface of the pillow cushion, and defining second voids over the second side of the stabilizing layer, the second voids opening to the second major surface, the second deformable wall members capable of being displaced into adjacent second voids upon deformation of the second deformable wall members, the stabilizing layer defining second ends of the second voids.

2. The pillow of claim 1, wherein the first voids have a first average size the second voids have a second average size, the first average size being smaller than the second average size.

3. The pillow of claim 2, wherein the first deformable wall members buckle when a pressure applied to the first major surface of the pillow cushion in a direction perpendicular to the first major surface exceeds a first threshold pressure level and the second deformable wall members buckle when a pressure applied to the second major surface in a direction perpendicular to the second major surface exceeds a second threshold pressure level different than the first threshold pressure level.

4. The pillow of claim 1, wherein the first voids comprise first triangular voids and the second voids comprise second triangular voids.

5. The pillow of claim 4, wherein at least some of the first triangular voids are misaligned with the second triangular voids.

6. The pillow of claim 1, wherein the first deformable wall members of a first portion of the pillow cushion have a first height, imparting the first portion with a first thickness and second deformable wall members of a second portion of the pillow cushion have a second height, imparting the second portion with a second thickness different from the first thickness.

7. The pillow of claim 1, further comprising:

apertures extending through the stabilizing layer so as to allow air flow through the stabilizing layer between at least some of the first voids and at least some of the second voids on opposite sides of the stabilizing layer.

8. A pillow, comprising:

a pillow cushion formed from a gelatinous elastomer, the pillow cushion comprising:

a first major surface;

a second major surface; and deformable wall members extending between the first major surface and the second major surface, the deformable wall members defining voids therebetween such that the deformable wall members may be displaced into adjacent voids upon deformation of the deformable wall members, the deformable wall members that buckle when a pressure applied to a cushioning surface of the pillow cushion, in a direction perpendicular to the first major surface, exceeds a threshold pressure level, first portions of the deformable wall members defining the first major surface and first portions of the voids with the first average size opening to the first major surface, second portions of the deformable wall members defining the second major surface and second portions of the voids with a second average size opening to the second major surface, the first average size being smaller than the second average size.

9. The pillow of claim 8, wherein the first major surface, the second major surface, and the deformable wall members form a single, unitary body of the pillow cushion.

10. The pillow of claim 8, wherein the deformable wall members in the first portion are configured to buckle when a pressure applied to a cushioning surface of the pillow cushion in the direction perpendicular to the first major surface exceeds a first threshold pressure level, and the deformable wall members of the second portion are configured to buckle when a pressure applied the cushioning surface of the pillow cushion in the direction perpendicular to the first major surface exceeds a second threshold pressure level that is different from the first threshold pressure level.

11. The pillow of claim 8, wherein the first portions of the voids comprise first triangular voids and the second portions of the voids comprise second triangular voids.

12. The pillow of claim 11, wherein the first triangular voids are misaligned with the second triangular voids in a direction perpendicular to the first major surface of the pillow cushion.

13. The pillow of claim 8, wherein the first portion of the pillow cushion has a first thickness, and the second portion has a second thickness different from the first thickness.

14. The pillow of claim 8, wherein the pillow cushion further comprises a stabilizing layer of the gelatinous elastomer between the first portion and the second portion of the pillow cushion.

15. The pillow of claim 14, wherein the pillow cushion further comprises apertures extending through the stabilizing layer.

16. The pillow of claim 14, wherein the first portion of the pillow cushion, the second portion of the pillow cushion, and the stabilizing layer of the pillow cushion comprise a single, unitary body.

17. A method of fabricating a pillow, comprising:

forming a pillow cushion from a gelatinous elastomer, including:

forming a stabilizing layer including a first side and a second side opposite from the first side;

forming first deformable wall members integrally with the stabilizing layer, extending from the first side of the stabilizing layer, and including first ends defining a first major surface of the pillow cushion, the first deformable wall members defining first voids over the first side of the stabilizing layer, the stabilizing layer defining first ends of the first voids, the first voids opening to the first major surface; and forming second deformable wall members integrally with the stabilizing layer, extending from the second side of the stabilizing layer, including second ends defining a second major surface of the pillow cushion, and defining second voids over the second side of the stabilizing layer, the stabilizing layer defining second ends of the second voids, the second voids opening to the second major surface.

18. The method of claim 17, further comprising:

placing a pillow cover over the pillow cushion.

19. A pillow cushion formed from a gelatinous elastomer, comprising:

a first major surface;

a second major surface; and deformable wall members extending between the first major surface and the second major surface, the deformable wall members defining voids therebetween such that the deformable wall members may be displaced into adjacent voids upon deformation of the deformable wall members, the deformable wall members that buckle when a pressure applied to a cushioning surface of the pillow cushion, in a direction perpendicular to the first major surface, exceeds a threshold pressure level, first portions of the deformable wall members defining the first major surface and first portions of the voids comprising first triangular voids opening to the first major surface, second portions of the deformable wall members defining the second major surface and second portions of the voids comprising second triangular voids opening to the second major surface, the first triangular voids being misaligned with the second triangular voids in a direction perpendicular to the first major surface.

20. The pillow cushion of claim 19, wherein the first major surface, the second major surface, and the deformable wall members form a single, unitary body of the pillow cushion.

21. The pillow cushion of claim 19, wherein the first portion of the pillow cushion has a first thickness, and the second portion has a second thickness different from the first thickness.

* * * * *